US010626807B2

(12) United States Patent
Matsushima et al.

(10) Patent No.: US 10,626,807 B2
(45) Date of Patent: Apr. 21, 2020

(54) CONTROLLER AND CONTROL METHOD FOR INTERNAL COMBUSTION ENGINE

(71) Applicant: Mitsubishi Electric Corporation, Tokyo (JP)

(72) Inventors: Yuhei Matsushima, Tokyo (JP); Takahiko Inada, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 297 days.

(21) Appl. No.: 15/701,573

(22) Filed: Sep. 12, 2017

(65) Prior Publication Data

US 2018/0306129 A1 Oct. 25, 2018

(30) Foreign Application Priority Data

Apr. 19, 2017 (JP) ..... 2017-082540

(51) Int. Cl.

| | |
|---|---|
| ***F02D 35/02*** | (2006.01) |
| ***F02P 17/12*** | (2006.01) |
| *F02D 41/22* | (2006.01) |
| *F02P 3/04* | (2006.01) |
| *F02P 5/15* | (2006.01) |
| *F02D 41/28* | (2006.01) |

(52) U.S. Cl.

CPC ..... *F02D 35/021* (2013.01); *F02P 17/12* (2013.01); *F02D 41/22* (2013.01); *F02D 2041/286* (2013.01); *F02P 3/04* (2013.01); *F02P 5/1502* (2013.01); *F02P 2017/125* (2013.01)

(58) Field of Classification Search

CPC ..... F02D 35/021; F02D 41/22; F02P 17/12
USPC ..... 702/179
See application file for complete search history.

(56) References Cited

U.S. PATENT DOCUMENTS

| | | | | |
|---|---|---|---|---|
| 5,925,819 | A * | 7/1999 | Yoshinaga | F02P 17/12 324/399 |
| 6,145,491 | A * | 11/2000 | Wilstermann | F02P 5/152 123/406.35 |
| 2003/0183195 | A1* | 10/2003 | Uchida | F02D 35/027 123/406.33 |
| 2004/0084018 | A1* | 5/2004 | Zhu | F01N 3/2006 123/406.14 |
| 2005/0114012 | A1* | 5/2005 | Zhu | F02D 41/22 701/114 |

(Continued)

FOREIGN PATENT DOCUMENTS

| | | |
|---|---|---|
| JP | 63-068774 A | 3/1988 |
| JP | 2009-057940 A | 3/2009 |

*Primary Examiner* — Ricky Ngon
(74) *Attorney, Agent, or Firm* — Sughrue Mion, PLLC; Richard C. Turner

(57) ABSTRACT

To provide a controller and a control method for an internal combustion engine capable of suppressing causing erroneous determination of combustion state even if noise component is superimposed on the ion current. In combustion state determination processing which determines combustion state of each combustion based on ion current, a controller for an internal combustion engine calculates a minimum value of ion current during a processing period, and prohibits determination of combustion state at a time point when the minimum value of ion current is below a preliminarily set determination prohibition threshold value.

8 Claims, 10 Drawing Sheets

(56) References Cited

U.S. PATENT DOCUMENTS

| | | | | |
|---|---|---|---|---|
| 2007/0079817 | A1* | 4/2007 | VanDyne | F02D 35/021<br>123/568.21 |
| 2007/0186903 | A1* | 8/2007 | Zhu | F01N 3/2006<br>123/406.37 |
| 2009/0084353 | A1* | 4/2009 | Inada | F02P 5/1455<br>123/406.12 |
| 2009/0173315 | A1* | 7/2009 | Inada | F02P 17/12<br>123/406.26 |
| 2011/0210744 | A1* | 9/2011 | Barrett | F02P 17/12<br>324/378 |

* cited by examiner

FIG. 10 IN THE CASE WHERE NOISE AMPLITUDE IS LARGE
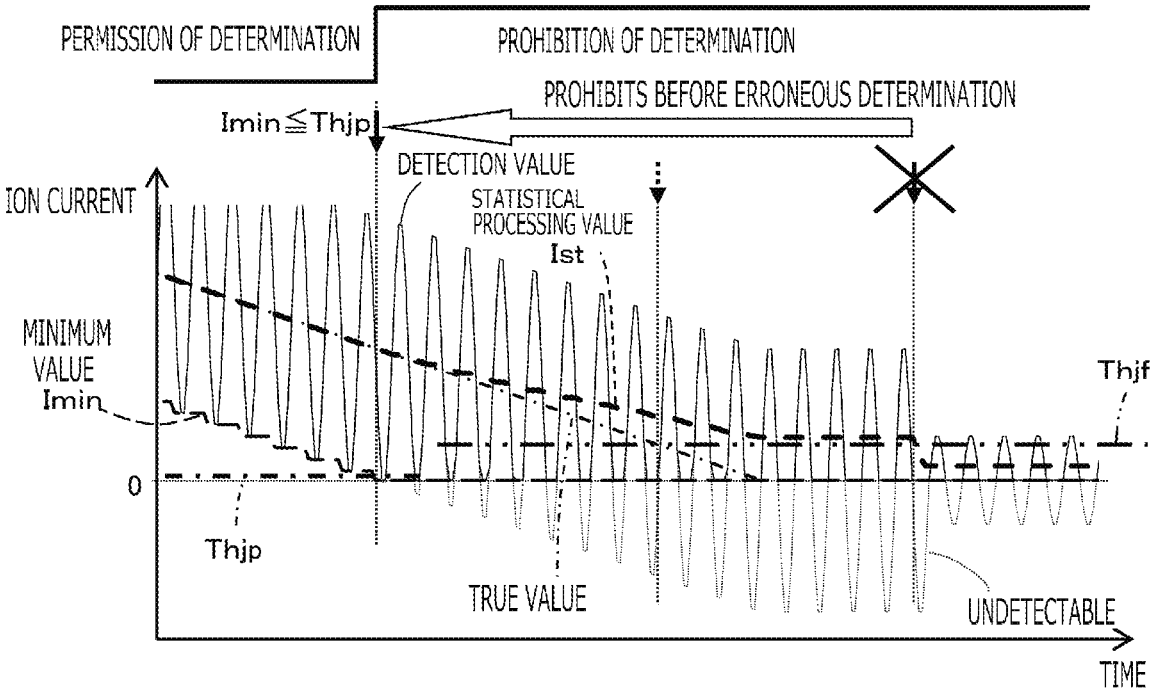
FIG. 11 IN THE CASE WHERE NOISE AMPLITUDE IS SMALL
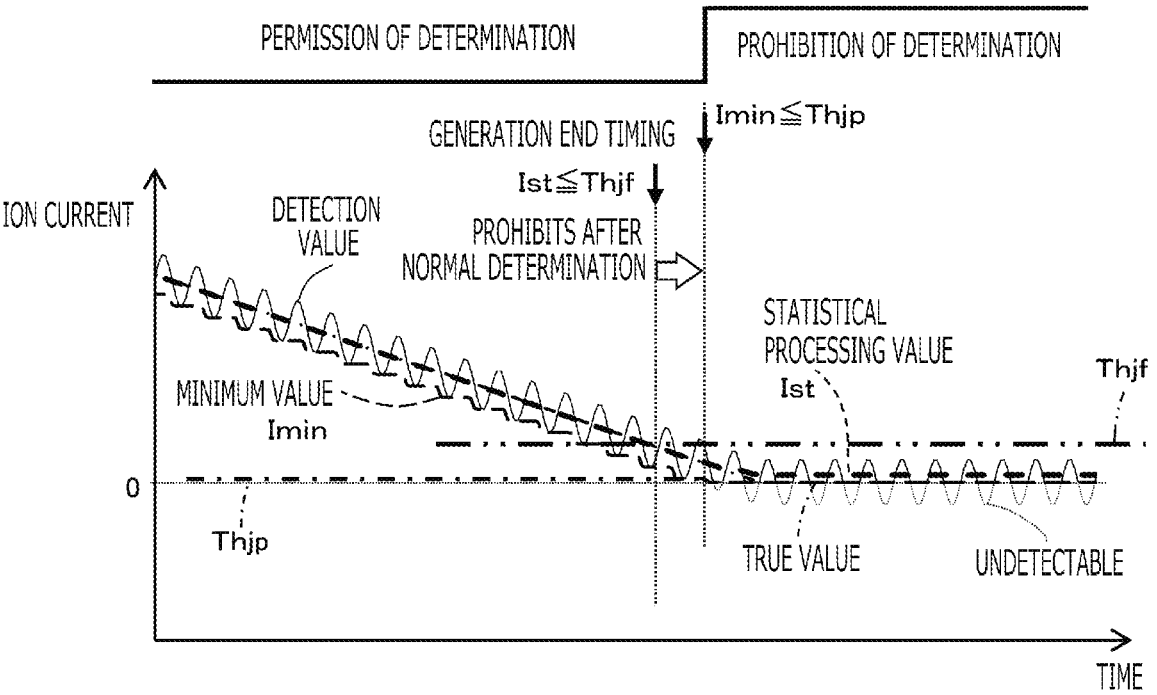

FIG. 12 IN THE CASE WHERE NOISE AMPLITUDE IS LARGE
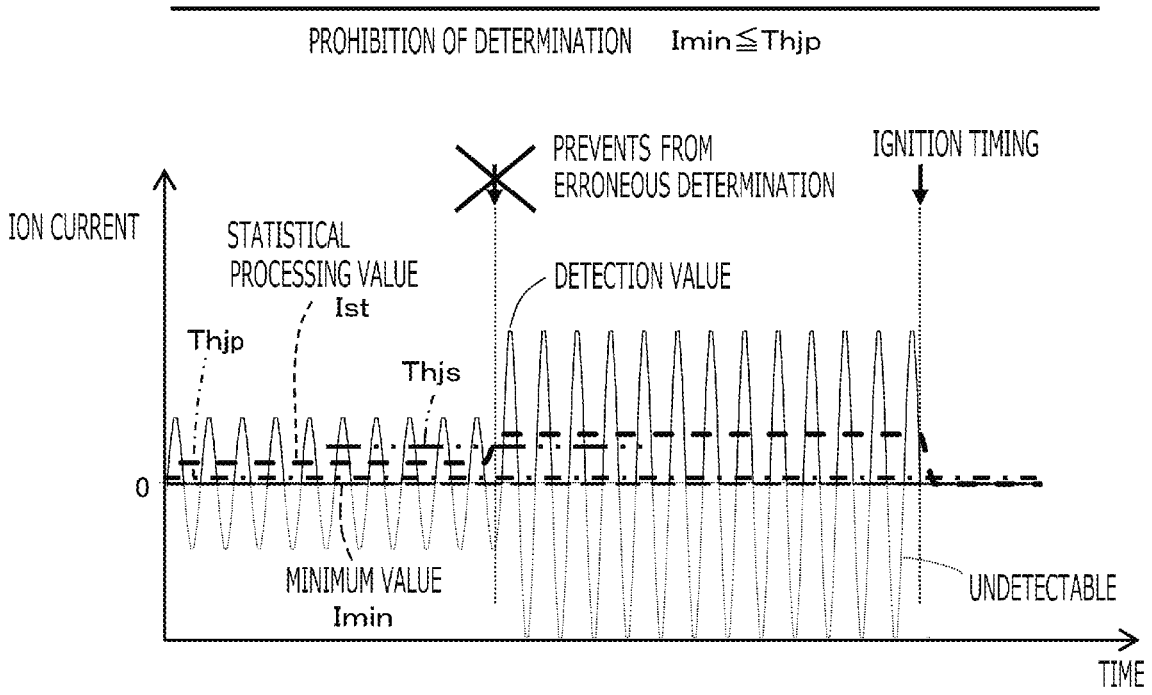

CONTROLLER AND CONTROL METHOD FOR INTERNAL COMBUSTION ENGINE

INCORPORATION BY REFERENCE

The disclosure of Japanese Patent Application No. 2017-082540 filed on Apr. 19, 2017 including its specification, claims and drawings, is incorporated herein by reference is its entirety.

BACKGROUND

The present invention relates to a controller and a control method for an internal combustion engine for determining a combustion state based on ion current.

To date, there has been known a controller for an internal combustion engine which determines a combustion state, such as preignition and knock, based on the ion current which flows into the discharge electrode of the spark plug. For example, in the technology disclosed in Japanese Patent Unexamined Application Publication No. 63-68774 (JP 63-68774 A), it is configured to determine that preignition with large intensity occurred in the case where generation of the ion current is detected before the ignition timing by the spark discharge of the spark plug.

In the technology disclosed in Japanese Patent Unexamined Application Publication No. 2009-57940 (JP 2009-57940 A), it is configured to determine the generation end timing of the ion current after the ignition timing, and determine the intensity of preignition based on the generation end timing.

SUMMARY

However, a noise component according to a noise component superimposed on the power source voltage supplied to the ignition coil may be superimposed on the detection value of the ion current, and the amplitude of the noise component of the ion current may become large. In this case, if combustion state, such as intensity of preignition, is determined based on the ion current like the technologies of JP 63-68774 A and JP 2009-57940 A, it may cause erroneous determination.

Thus, it is desirable to provide a controller and a control method for an internal combustion engine capable of suppressing causing erroneous determination of combustion state even if noise component is superimposed on the ion current.

A controller for an internal combustion engine according to the present invention is a controller for an internal combustion engine that is provided with an spark plug which ignites a fuel-air mixture in a combustion chamber, an ignition coil which supplies an ignition energy to the spark plug, and an ion current detection circuit which outputs an output signal according to an ion current which flows into a discharge electrode of the spark plug, the controller for the internal combustion engine including:

an ion current detector that detects the ion current generated by combustion of the fuel-air mixture based on the output signal of the ion current detection circuit, and a combustion state determination calculator that determines a combustion state of each combustion based on the ion current during a determination period which is set corresponding to a combustion period of each combustion, wherein the combustion state determination calculator calculates a minimum value of the ion current during a processing period at each time point of the determination period, and prohibits determination of the combustion state at a time point when the minimum value of the ion current is below a preliminarily set determination prohibition threshold value.

A control method for an internal combustion engine according to the present invention is a control method for an internal combustion engine that is provided with a spark plug which ignites a fuel-air mixture in a combustion chamber, an ignition coil which supplies an ignition energy to the spark plug, and an ion current detection circuit which outputs an output signal according to an ion current which flows into a discharge electrode of the spark plug, the control method for the internal combustion engine including:

an ion current detecting that detects the ion current generated by combustion of the fuel-air mixture based on the output signal of the ion current detection circuit, and a combustion state determining that determines a combustion state of each combustion based on the ion current during a determination period which is set corresponding to a combustion period of each combustion, wherein the combustion state determining calculates a minimum value of the ion current during a processing period at each time point of the determination period, and prohibits determination of the combustion state at a time point when the minimum value of the ion current is below a preliminarily set determination prohibition threshold value.

In the case where the amplitude of the noise component superimposed on the ion current is large, when the true value of the ion current drops, the lower part of the vibration component of the ion current reaches 0, and erroneous determination of combustion state may cause. According to the controller and the control method for the internal combustion engine concerning the present invention, at a time point when the minimum value of the ion current is below the determination prohibition threshold value, since it includes the case where the true value of the ion current is dropping in the state where the amplitude of the noise component of the ion current is large, determination of the combustion state at this time point is prohibited, and erroneous determination of the combustion state can be suppressed. Therefore, even if noise component is superimposed on the ion current, erroneous determination of the combustion state can be suppressed.

BRIEF DESCRIPTION OF THE DRAWINGS

FIG. 10 is a time chart for explaining prohibition of determination of the generation end timing of the ion current performed in the case where the noise amplitude is large, according to Embodiment 1 of the present invention;

FIG. 11 is a time chart for explaining normal determination of the generation end timing of the ion current performed in the case where the noise amplitude is small, according to Embodiment 1 of the present invention;

FIG. 12 is a time chart for explaining prohibition of determination of the generation start timing of the ion current performed in the case where the noise amplitude is large, according to Embodiment 1 of the present invention;

DETAILED DESCRIPTION OF THE EMBODIMENTS

Embodiment 1

Figure 1:
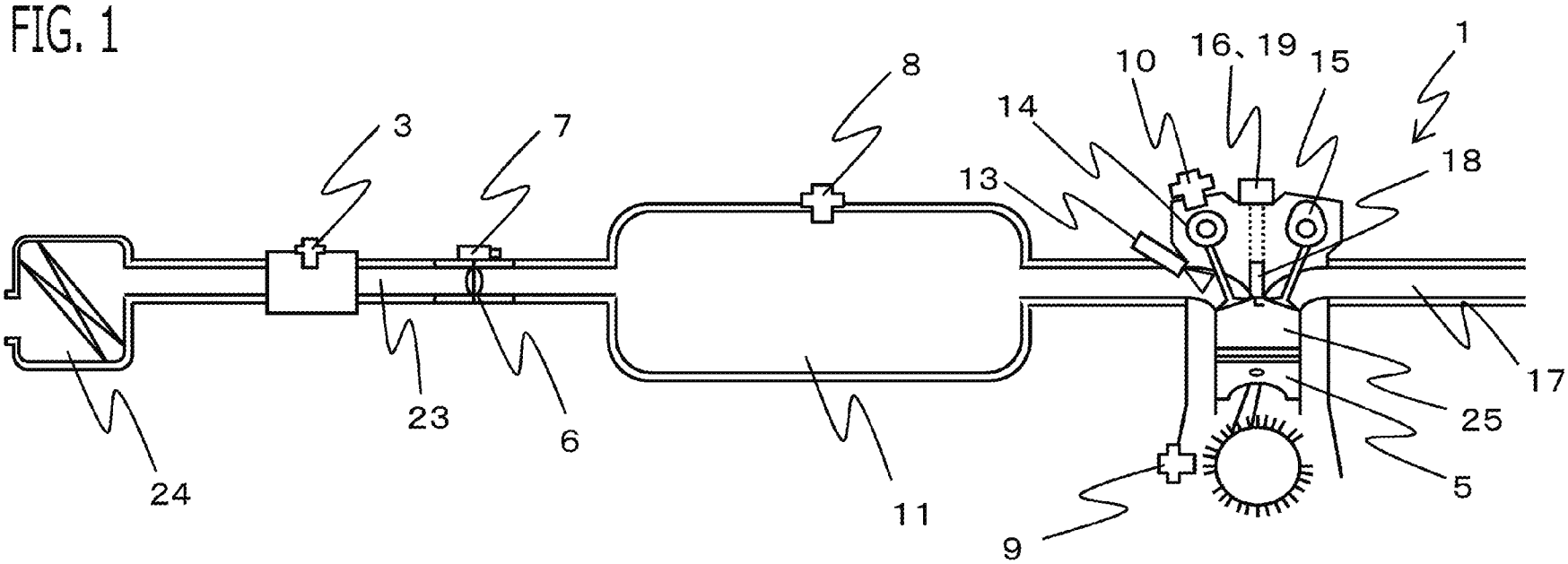
FIG. 1 is a schematic configuration diagram of the internal combustion engine according to Embodiment 1 of the present invention.

A controller 50 for an internal combustion engine 1 (hereinafter, referred to simply as the controller 50) according to Embodiment 1 will be explained with reference to the drawings. FIG. 1 is a schematic configuration diagram of the internal combustion engine 1 according to the present embodiment. Although the internal combustion engine 1 is provided with a plurality of combustion chambers 25 and pistons 5 according to the present embodiment, only the one combustion chamber 25 is shown in FIG. 1 for convenience. The internal combustion engine 1 and the controller 50 are mounted in a vehicle; the internal combustion engine 1 functions as a driving-force source for the vehicle (wheels).

1. The Configuration of the Internal Combustion Engine 1

The configuration of the internal combustion engine 1 will be explained. The internal combustion engine 1 has a plurality of combustion chambers 25 (for example, four combustion chambers 25) in which a fuel-air mixture is combusted. The combustion chamber 25 is configured by a cylinder and a piston 5. Hereinafter, the combustion chamber 25 is also referred to the cylinder. The internal combustion engine 1 is provided with an intake path 23 for supplying air to the each combustion chamber 25 and an exhaust path 17 for discharging exhaust gas from the each combustion chamber 25. The internal combustion engine 1 has a throttle valve 6 for opening and closing the intake path 23. The throttle valve 6 is an electronically controlled throttle valve that is opening/closing-driven by an electric motor controlled by the controller 50. The throttle valve 6 is provided with a throttle opening degree sensor 7 that generates an electric signal according to a throttle opening degree of the throttle valve 6.

An air cleaner 24 for purifying air taken into the intake path 23 is provided at the most upstream part of the intake path 23. An air flow sensor 3 which outputs an electric signal according to an intake air amount taken into the intake path 23 is provided in a part of the intake path 23 at the upstream side of throttle valve 6. The part of the intake path 23 at the downstream side of the throttle valve 6 is an intake manifold 11, and is connected to a plurality of combustion chambers 25. The upstream side part of the intake manifold 11 is a surge tank for suppressing an intake pulsation.

A manifold pressure sensor 8 which outputs an electric signal according to a manifold pressure which is a gas pressure in the intake manifold 11 is provided in the intake manifold 11. Either one of the air flow sensor 3 or the manifold pressure sensor 8 may be provided. An injector 13 for injecting a fuel is provided in an intake port which is the downstream side part of the intake manifold 11. The injector 13 may be provided in such a way as to inject a fuel directly into the combustion chamber 25.

A spark plug 18 for igniting the fuel-air mixture in the combustion chamber 25 and an ignition coil 16 for supplying ignition energy to the spark plug 18 are provided on the top of the each combustion chamber 25. On the top of the each combustion chamber 25, there are provided an intake valve 14 for adjusting the amount of intake air to be taken from the intake path 23 into the combustion chamber 25 and an exhaust valve 15 for adjusting the amount of exhaust gas to be exhausted from the combustion chamber 25 to the exhaust path 17. The intake valve 14 is provided with an intake variable valve timing mechanism that makes the opening and closing timing thereof variable. The exhaust valve 15 is provided with an exhaust variable valve timing mechanism that makes the opening and closing timing thereof variable. Each of the intake and the exhaust variable valve timing mechanisms 14, 15 has an electric actuator which changes a phase angle of the opening and closing timing of the valve. The electric actuator is an electric motor which changes the phase angle.

A crankshaft of the internal combustion engine 1 is provided with a signal plate in which a plurality of teeth were provided in the outer circumference with the preliminarily set angle interval. A crank angle sensor 9 is fixed to a cylinder block so as to oppose the tooth of the signal plate of the crankshaft and outputs a pulse signal synchronizing with passage of the tooth. Although not shown in the figure, a cam shaft of the internal combustion engine 1 is provided with a signal plate in which a plurality of teeth were provided in the outer circumference with the preliminarily set angle interval. A cam angle sensor 10 is fixed so as to oppose the tooth of the signal plate of the cam shaft and outputs a pulse signal synchronizing with passage of the tooth. Based on two kinds of output signals of the crank angle sensor 9 and the cam angle sensor 10, the controller 50 detects a crank angle on the basis of the top dead center of each piston 5 and determines a stroke of each combustion chamber 25.

<Ion Current Detection Circuit 19, Ignition Coil 16, Spark Plug 18>

An ion current detection circuit 19 which outputs an output signal according to a current which flows into a discharge electrode 181 of each spark plug 18 is provided. One ion current detection circuit 19, one ignition coil 16, and one spark plug 18 are provided for each of a plurality of the combustion chambers 25. In the present embodiment, the ignition coil 16 and the ion current detection circuit 19 are integrally configured.

Figure 2:
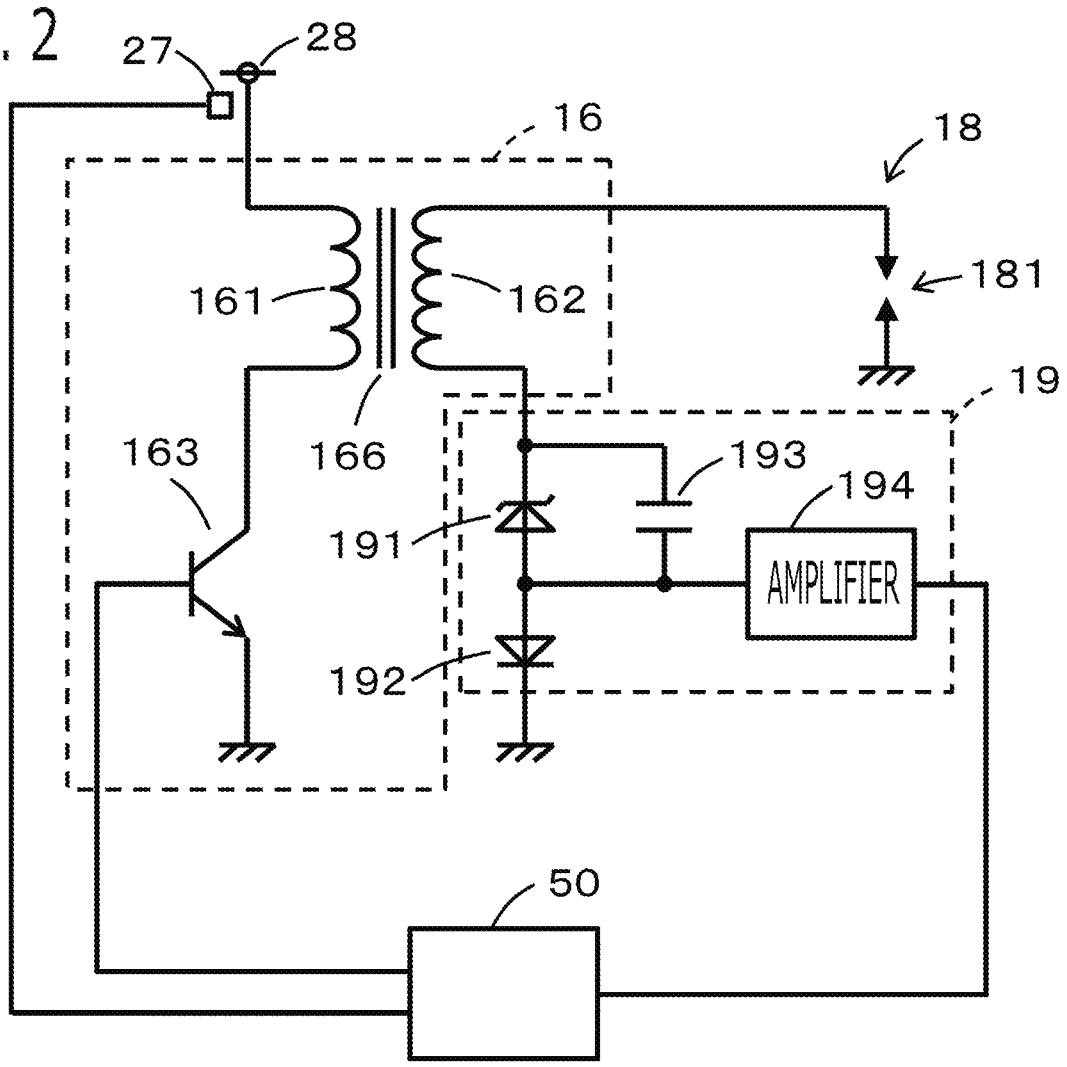
FIG. 2 is a schematic circuit diagram of an ion current detection circuit, a spark plug, and an ignition coil according to Embodiment 1 of the present invention.

FIG. 2 shows a circuit configuration diagram of the ion current detection circuit 19, the ignition coil 16, and the spark plug 18, which are provided in the one combustion chamber 25. The spark plug 18 is provided with the discharge electrode 181 which is disposed in the combustion chamber 25 and generates the spark discharge. The ignition coil 16 is provided with a primary coil 161 to which power is supplied from a direct current power source 28, and a secondary coil 162 which has more winding number than the primary coil 161 and generates the high voltage supplied to the spark plug 18. The primary coil 161 and the secondary coil 162 are wound around the common core 166. The primary coil 161, the secondary coil 162, and the core 166 constitute a step-up transformer. The ignition coil 16 is provided with a switching device as the igniter 163 which turns on or turns off the electrical connection from the direct current power source 28 to the primary coil 161.

One end of the primary coil 161 is connected to the positive electrode of the direct current power source 28, and the other end of the primary coil 161 is connected to the ground (the negative electrode of the direct current power source 28) via the igniter 163. By controlling on/off of the igniter 163 by the controller 50, the electrical connection from the direct current power source 28 to the primary coil 161 is turned on or turned off. A power source voltage sensor 27 which detects a power source voltage supplied to the primary coil 161 from the direct current power source 28 is provided. One end of the secondary coil 162 is connected to the ground via the discharge electrode 181 of the spark plug 18, and the other end of the secondary coil 162 is connected to the ground via two diodes 191, 192 of the ion current detection circuit 19.

The ion current detection circuit 19 is provided with a Zener diode 191 and a diode 192 which are reversely connected in series with each other between the other end of the secondary coil 162 and the ground, a capacitor 193 which is connected in parallel with the Zener diode 191, and an amplifier 194 which amplifies a voltage according to the ion current to output as the output signal of the ion current detection circuit 19.

The capacitor 193 is charged by the discharge current which flows through the discharge electrode 181 during a spark discharge period until the inter-electrode voltage reaches a breakdown voltage (a bias voltage) of the Zener diode 191. The bias voltage of the capacitor 193 is applied to the discharge electrode 181 of the spark plug 18 in a period other than the spark discharge period, and the ion generated when fuel-air mixture burned flows through the discharge electrode 181 as the ion current. As a result, a current according to the ion current flows into the capacitor 193 via a resistance in the amplifier 194, and the both-ends voltage of the resistance in the amplifier 194 becomes a voltage according to the ion current. Then, the both-ends voltage of the resistance in the amplifier 194 is amplified by an operational amplifier in the amplifier 194, and is outputted to the controller 50 as the output signal.

The ion current detection circuit 19 is configured to detect the ion current of the positive side, and cannot detect the ion current of the negative side. For example, the ion current detection circuit 91 is provided with a diode which blocks current in a flowing direction from the capacitor 193 to the resistance in the ion current detection circuit 19. An A/D converter of the controller 50 does not convert the output signal of the ion current detection circuit 19 corresponding to the ion current of the negative side.

2. The Configuration of the Controller 50

Figure 3:
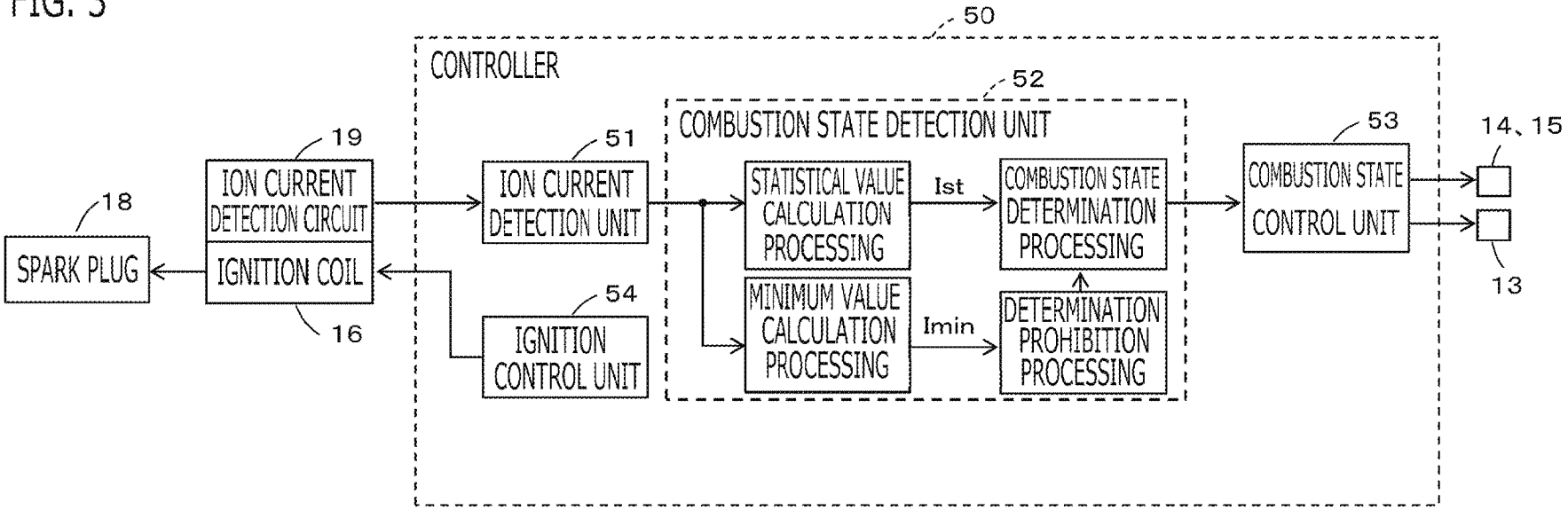
FIG. 3 is a block diagram of a controller according to Embodiment 1 of the present invention.
Figure 14:
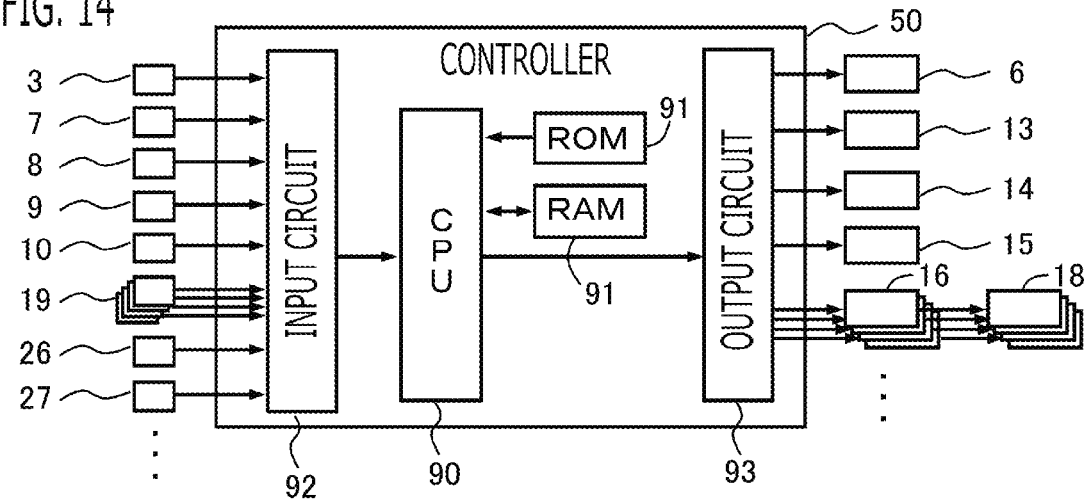
FIG. 14 is a hardware configuration diagram of the controller according to Embodiment 1 of the present invention.

Next, the controller 50 will be explained. The controller 50 is the one whose control subject is the internal combustion engine 1. As shown in the block diagram of FIG. 3, the controller 50 is provided with control units of an ion current detection unit 51, a combustion state determination unit 52, a combustion state control unit 53, an ignition control unit 54, and the like. The respective control units 51 through 54 and the like of the controller 50 are realized by processing circuits included in the controller 50. Specifically, as shown in FIG. 14, the controller 50 includes, as a processing circuit, a computing processing unit (computer) 90 such as a CPU (Central Processing Unit), storage apparatuses 91 that exchange data with the computing processing unit 90, an input circuit 92 that inputs external signals to the computing processing unit 90, an output circuit 93 that outputs signals from the computing processing unit 90 to the outside, and the like.

As the computing processing unit 90, ASIC (Application Specific Integrated Circuit), IC (Integrated Circuit), DSP (Digital Signal Processor), FPGA (Field Programmable Gate Array), various kinds of logical circuits, various kinds of signal processing circuits, and the like may be provided. As the computing processing unit 90, a plurality of the same type ones or the different type ones may be provided, and each processing may be shared and executed. As the storage apparatuses 91, there are provided a RAM (Random Access Memory) which can read data and write data from the computing processing unit 90, a ROM (Read Only Memory) which can read data from the computing processing unit 90, and the like. The input circuit 92 is connected with various kinds of sensors and switches and is provided with an A/D converter and the like for inputting output signals from the sensors and the switches to the computing processing unit 90. The output circuit 93 is connected with electric loads and is provided with a driving circuit and the like for outputting a control signal from the computing processing unit 90.

In addition, the computing processing unit 90 runs software items (programs) stored in the storage apparatus 91 such as a ROM and collaborates with other hardware devices in the controller 50, such as the storage apparatus 91, the input circuit 92, and the output circuit 93, so that the respective functions of the control units 51 through 54 included in the controller 50 are realized. Setting data items such as maps and determination value to be utilized in the control units 51 through 54 are stored, as part of software items (programs), in the storage apparatus 91 such as a ROM.

In Embodiment 1, the input circuit 92 is connected with various kinds of sensors such as the air flow sensor 3, the throttle position sensor 7, the manifold pressure sensor 8, the crank angle sensor 9, the cam angle sensor 10, a plurality of the ion current detection circuits 19 (in this example, four) for the each combustion chamber 25, the accelerator position sensor 26, and the power source voltage sensor 27. The output circuit 93 is connected with various kinds of actuators such as the throttle valve 6 (the electric motor), the injector 13, the intake variable valve timing mechanism 14, the exhaust variable valve timing mechanism 15, and a plurality of the ignition coils 16 (in this example, four) for the each combustion chamber 25. The controller 50 is connected with various kinds of unillustrated sensors, switches, actuators, and the like.

The controller 50 detects an intake air amount based on the output signal of the air flow sensor 3 or the manifold pressure sensor 8 and the like, detects a throttle opening angle based on the output signal of the throttle position sensor 7, and detects an accelerator opening degree based on the output signal of the accelerator position sensor 26. The controller 50 detects an angle and a rotational speed of the crankshaft, and the opening and closing timings of the intake valve 14 and the exhaust valve 15, based on the output signal of the crank angle sensor 9 and the cam angle sensor 10.

As basic control, the controller 50 calculates a fuel injection amount, an ignition timing, and the like, based on inputted output signals and the like from the various kinds of sensors, and then performs driving control of the injector 13, the ignition coil 16, and the like. Based on the accelerator opening degree and the like, the controller 50 calculates the output torque of the internal combustion engine 1 demanded by the driver, and then controls the throttle valve 6 and the like so that an intake air amount for realizing the demanded output torque is obtained. Specifically, the controller 50 calculates a target throttle opening degree and performs driving control of the electric motor for the throttle valve 6 so that the throttle opening degree approaches the target throttle opening degree. The controller 50 calculates target opening and closing timings of the intake valve 14 and the exhaust valve 15 based on the rotational speed of the crankshaft (the internal combustion engine 1), the intake air amount, and the like, respectively, and then performs driving control of the electric actuators for the intake and the exhaust variable valve timing mechanisms 14, 15 so that the opening and closing timings of the intake valve 14 and the exhaust valve 15 approaches the target opening and closing timings, respectively.

2-1. The Ignition Control Unit 54

The ignition control unit 54 implements an ignition control processing that shuts down after connecting electrically the primary coil 161 and the direct current power source 28 for generating high voltage in the secondary coil 162 and generating spark discharge in the discharge electrode 181. The ignition control unit 54 calculates an energizing time and an ignition timing (an ignition crank angle) to the primary coil 161. After the ignition control unit 54 turns on the igniter 163 and energizes the primary coil 161 during the energizing time, the ignition control unit 54 turns off the igniter 163 at the ignition timing and shuts down the energization of the primary coil 161 to generate spark discharge. Spark discharge is continued until the magnetic energy accumulated in the core 166 decreases.

2-2. The Ion Current Detection Unit 51

The ion current detection unit 51 implements an ion current detection processing that detects the ion current generated by combustion of the fuel-air mixture based on the output signal of the ion current detection circuit 19. The Ion current detection unit 51 performs the A/D conversion of the output signal of the ion current detection circuit 19 in a sampling period shorter than one half of the cycle of the noise component superimposed on the detected ion current (for example, less than or equal to 1/10 of the cycle of the noise component). The ion current detection unit 51 performs the A/D conversion continuously for every sampling period during the determination period Tj set corresponding to the combustion period of each combustion, and stores the detection value of each ion current to the storage apparatus 91, such as RAM, by correlating with the crank angle at the detecting time point and the like. The determination period Tj of each cylinder is set to a predetermined crank angle interval on the basis of the top dead center of the piston of each cylinder (for example, a crank angle interval from 60° before the top dead center to 90° after the top dead center).

2-3. The Combustion State Determination Unit 52

The combustion state determination unit 52 implements a combustion state determination processing that determines a combustion state of each cylinder based on the ion current during the determination period Tj set corresponding to the combustion period of each combustion (for example, the crank angle interval from 60° before the top dead center to 90° after the top dead center). The combustion state determination unit 52 determines the combustion state at a predetermined crank angle after the determination period Tj, based on the detection value of the ion current during the determination period Tj stored in the storage apparatus 91.

<Noise Component Superimposed on Ion Current>

Figure 4:
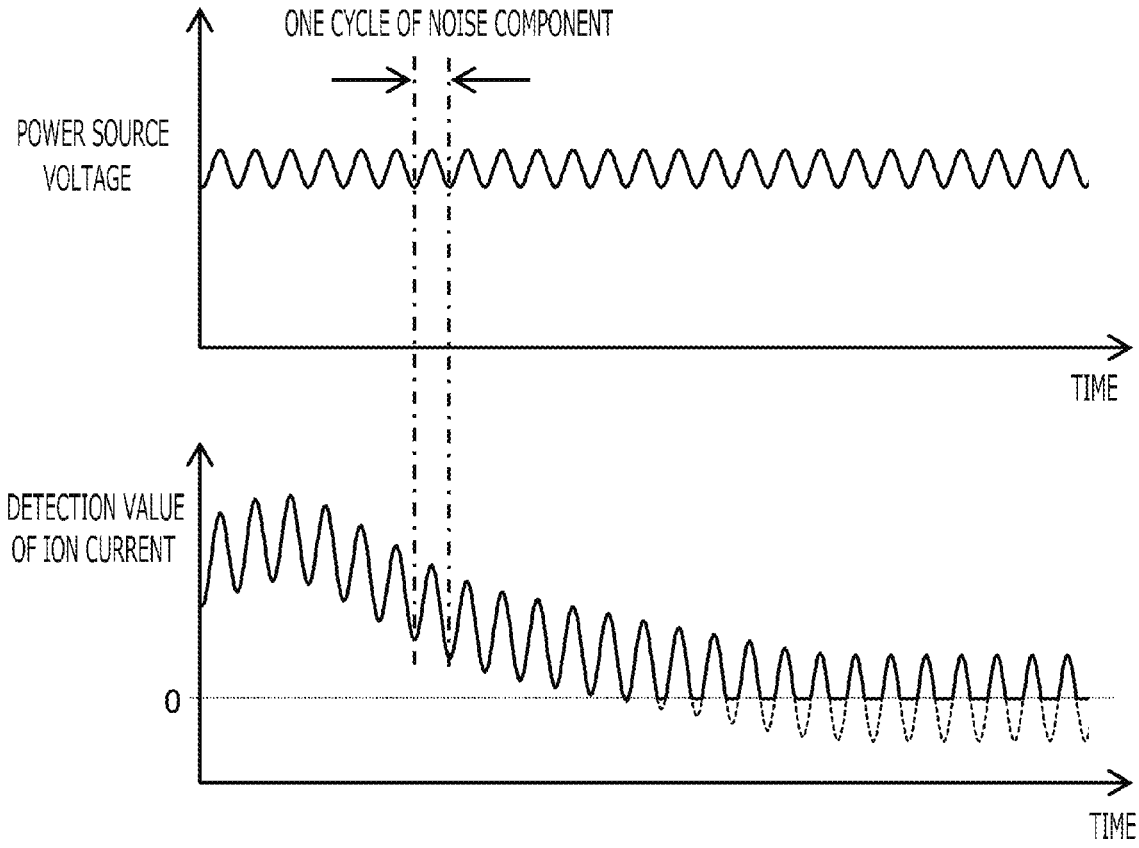
FIG. 4 is a time chart for explaining noise component superimposed on the detection value of the ion current, according to Embodiment 1 of the present invention.

As shown in FIG. 4, a periodic noise component is superimposed on the power source voltage of the direct current power source 28 supplied to the ignition coil 16. This periodic noise component of the power source voltage is caused by a periodic noise component superimposed on a voltage generated by an alternator, a periodic noise component caused by the drive of the electric actuator (in this example, the electric motor) of the intake and the exhaust variable valve timing mechanisms 14, 15, and the like.

The periodic noise component of the power source voltage is transmitted to the secondary coil 162 side via the primary coil 161 and the core 166, and be superimposed on the output signal of the ion current detection circuit 19 as the periodic noise component of the ion current. When the amplitude of the periodic noise component of the power source voltage increases or decreases, the amplitude of the periodic noise component superimposed on the output signal of the ion current detection circuit 19 also increases or decreases according to the increase or decrease of the amplitude. Thus, if the ion current on which the periodic noise component is superimposed is used as it is, the combustion state cannot be determined with good accuracy.

<Reduction of Noise Component by Statistical Processing>

Accordingly, in order to reduce the noise component, the combustion state determination unit 52 calculates a statistical processing value Ist of the ion current during a processing period ΔTc at each time point of the determination period Tj. According to this configuration, the noise component of the ion current can be reduced by the statistical processing.

The processing period ΔTc is set to a period greater than or equal to one cycle of the periodic noise component superimposed on the ion current (for example, natural number times of one cycle). As mentioned above, the noise component of the ion current is according to the noise component superimposed on the power source voltage. Accordingly, in the present embodiment, the combustion state determination unit 52 sets the processing period ΔTc to a period greater than or equal to one cycle of the periodic noise component superimposed on the power source voltage supplied to the ignition coil 16. The combustion state determination unit 52 determines the cycle of the noise component superimposed on the power source voltage based on the output signal of the power source voltage sensor 27, and sets the processing period ΔTc to a period obtained by multiplying a preliminarily set coefficient greater than or equal to one (for example, a natural number greater than or equal to one) to the determined cycle of the noise component of the power source voltage.

In the present embodiment, the combustion state determination unit 52 calculates, as the statistical processing value Ist, an average value (a moving average value) of the ion current during the processing period ΔTc, or a median value of a maximum value and a minimum value of the ion current during the processing period ΔTc.

For example, the combustion state determination unit 52 changes a processing time point tp from the start point of the determination period Tj to the end point, and repeatedly performs moving average processing that calculates the average value of the ion current sampled during the processing period ΔTc centered at the processing time point tp (from tp−ΔTc/2 to tp+ΔTc/2), to calculate the average value at each time point of the determination period Tj.

Alternatively, the combustion state determination unit 52 changes the processing time point tp from the start point of the determination period Tj to the end point, and repeatedly performs median value calculation processing that calculates the maximum value and the minimum value of the ion current sampled during the processing period ΔTc centered at the processing time point tp (from tp−ΔTc/2 to tp+ΔTc/2), and calculates the median value (average value) of the maximum value and the minimum value, to calculate the median value at each time point of the determination period Tj.

By performing such statistical processing, the statistical processing value Ist of the ion current whose noise component was reduced can be calculated, and it becomes easy to perform determination of the combustion state.

<Detection of Preignition>

In the present embodiment, the combustion state determination unit 52 determines an occurrence and a sign of preignition as the combustion state. The preignition is a phenomenon in which the overheated spark plug 18 or the carbon sludge accumulated into the combustion chamber 25 becomes a heat source, and the compressed fuel-air mixture causes self-ignition before spark ignition.

Figure 5:
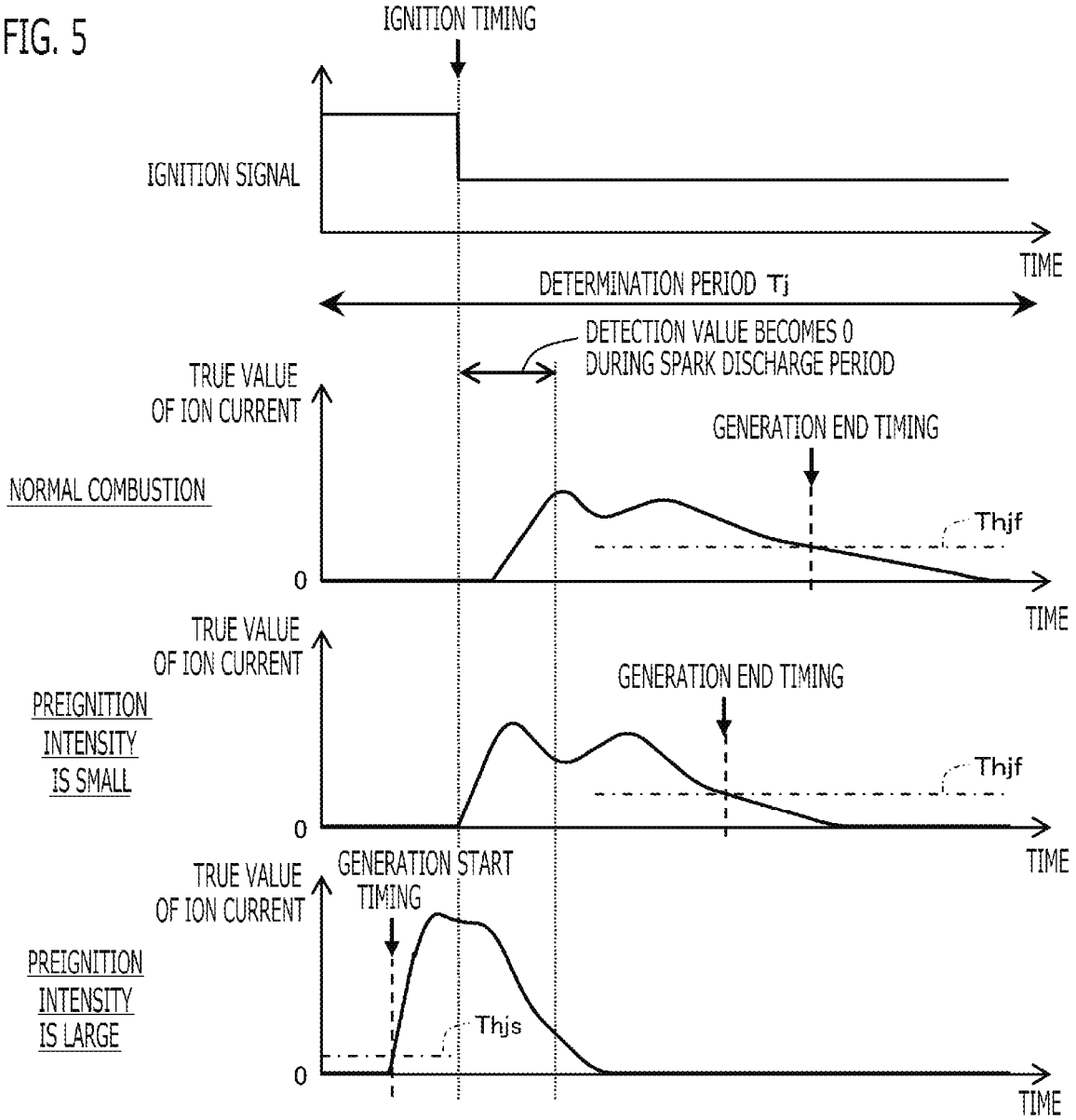
FIG. 5 is a time chart showing as image of the ion current of each combustion state in the case of supposing that the noise component is not superimposed, according to Embodiment 1 of the present invention.

The waveform of the ion current will be explained. FIG. 5 shows an image of a waveform of the ion current (true value of ion current) during the determination period Tj in the case where the noise component is not superimposed. As mentioned above, although the detection value of ion current becomes 0 during the spark discharge period and the ion current cannot be detected, FIG. 5 shows a waveform when it is assumed that the ion current can be detected during the spark discharge period. In normal combustion, two crests of the first half and the latter half appear in the waveform of the ion current. It is considered that an ion which exists in a flame front expanding with growth of a flame kernel after fuel-air mixture is ignited becomes a medium of the ion current which appears in the crest of the first half, and especially this is strongly affected by the speed of initial combustion and the flow strength in the combustion chamber 25. Therefore, as initial combustion becomes more active, the crest of the first half becomes steeper and the peak value advances more. The crest of the first half overlaps with the spark discharge period and may be unable to be detected by the detection value of ion current.

On the other hand, it is considered that an ion generated by the burning reaction itself as described above and an ion generated when NOx which exists in existing gas is thermally ionized with a temperature rise in the combustion chamber 25 becomes a medium of the ion current which appears in the crest of the latter half. The peak appears at the crank angle at which the temperature in the combustion chamber 25 becomes the highest. The peak becomes higher as combustion is more active as a whole, and the peak becomes lower as combustion is slower.

In contrast to the waveform of the ion current at this normal combustion, when there is the sign and the occurrence of preignition, the rise of the ion current advances as compared with the normal combustion, and the end timing of the ion current also advances as compared with the normal combustion. As the generation start timing and the generation end timing of the ion current become the advance angle side more, the intensity of preignition becomes larger. As the peak timing of the crest of the latter half becomes the advance angle side more, the intensity representing the sign and the occurrence of preignition becomes larger. If the ion current begins to be generated before the ignition timing, preignition occurs and its intensity becomes very large.

The combustion state determination unit 52 determines a time point (crank angle) when the statistical processing value Ist of the ion current during the determination period Tj becomes lower than a preliminarily set end determination threshold value Thjf after the ignition timing, as the generation end timing of the ion current. Then, the combustion state determination unit 52 determines that the intensity of preignition becomes larger as the determined generation end timing of the ion current becomes the advance angle side more than a preliminarily set generation end timing of the ion current at the normal combustion.

The combustion state determination unit 52 determines a time point (crank angle) when the statistical processing value Ist of the ion current during the determination period Tj becomes higher than a preliminarily set start determination threshold value Thjs before the ignition timing, as the generation start timing of the ion current. The combustion state determination unit 52 determines that the intensity of preignition is very large in the case where the generation start timing of the ion current is before the ignition timing.

<Erroneous Determination by Float from 0 of Statistical Processing Value Ist by Noise Component>

Figure 6:
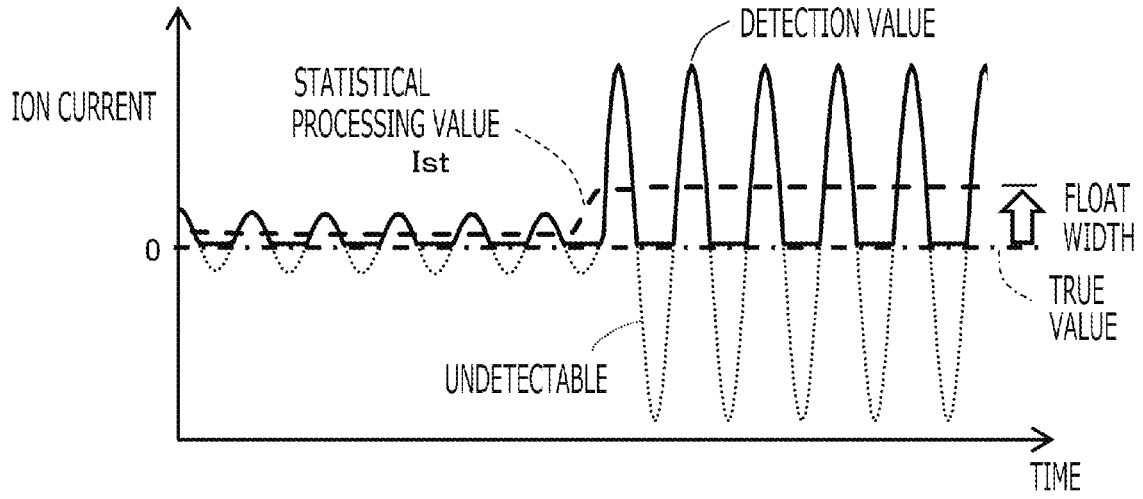
FIG. 6 is a time chart for explaining the float from 0 of the statistical processing value by noise component, according to Embodiment 1 of the present invention.

Since it is not configured to detect the ion current of the negative side as mentioned above, as shown in FIG. 6, even in the case where ion is not generated in the combustion chamber 25 and the true value of the ion current is 0, if the periodic noise component is superimposed on the power source voltage, the detection value of the ion current oscillates between zero and one half of the amplitude. That is to say, the negative side half of the amplitude of the noise component is not detected as the ion current. Therefore, if the noise component is superimposed on the detection value of the ion current, even in the case where the ion generation amount in the combustion chamber 25 is low and the true value of the ion current is around zero, the statistical processing value Ist, such as the moving average value or the median value of the ion current, becomes about ¼ of the amplitude of the noise component, and floats from 0.

In the case where the amplitude of the noise component of the power source voltage increases and the amplitude of the noise component of the ion current increases, the float width from 0 of the statistical processing value Ist of the ion current also increases according to the increase in the amplitude. Since the amplitude of the noise component is not constant and fluctuates wildly irregularly, the float width from 0 of the statistical processing value Ist also fluctuates according to fluctuation of the amplitude of the noise component.

Figure 7:
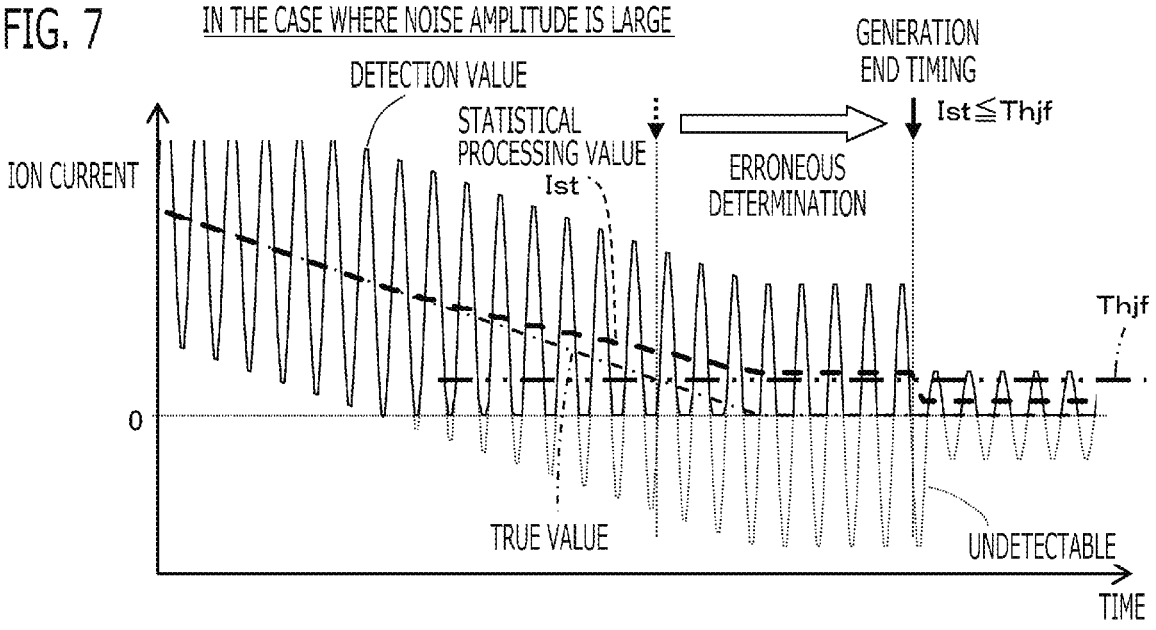
FIG. 7 is a time chart for explaining erroneous determination of the generation end timing of the ion current caused in the case where the noise amplitude is large, for explaining a problem.

For example, as shown in FIG. 7, even when the crest of the latter half of the ion current ends and the true value of the ion current drops to around zero, in the case where the amplitude of the noise component is large by chance, the float width from 0 of the statistical processing value Ist becomes large, the statistical processing value Ist is not below the end determination threshold value Thjf, and the generation end timing of the ion current cannot be determined. After that, when the amplitude of the noise component becomes small by chance, the float width from 0 of the statistical processing value Ist becomes small, the statistical processing value Ist becomes below the end determination threshold value Thjf, and the generation end timing of the ion current is determined. Like this, the irregular fluctuation timing of the amplitude of the noise component is determined erroneously as the generation end timing of the ion current Against this, although it is also considered to set the end determination threshold value Thjf to a larger value to match the case where the amplitude of the noise component becomes the maximum, since the maximum value of the amplitude of the noise component is not small compared with the peak of the crest of the ion current, the end determination threshold value Thjf becomes large too much, and it becomes difficult to determine the generation end timing of the on current with good accuracy.

Figure 8:
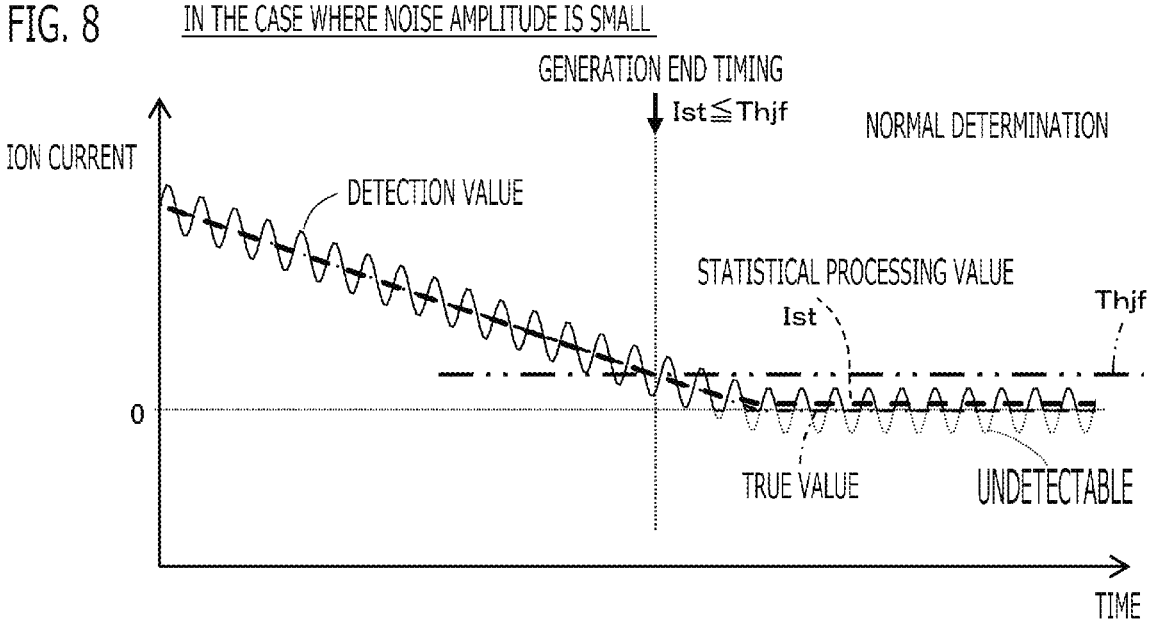
FIG. 8 is a time chart for explaining normal determination of the generation end timing of the ion current performed in the case where the noise amplitude is small, for explaining a problem.

On the other hand, as shown in FIG. 8, since the fluctuation pattern of the amplitude of the noise component varies for every combustion, when the true value of ion current drops to around zero, the amplitude of the noise component may be small, the float width from 0 of the statistical processing value Ist may become small, the statistical processing value Ist may be below the end determination threshold value Thjf, and the generation end timing of the ion current may be determined normally. Therefore, the determination result of combustion time in which normal determination is performed can be used.

As described above, when the generation end timing of the ion current cannot be determined even though the true value of the ion current dropped to around zero, since there is a possibility that the fluctuation timing of the amplitude of the noise component is determined erroneously as the generation end timing of the ion current if determination is continued, it is considered to stop determination of the combustion state of this combustion time. On the other hand, when the generation end timing of ion current can be determined before the true value of the ion current drops to around zero, it is considered that the amplitude of the noise component at the determination timing is small and normal determination is performed.

Figure 9:
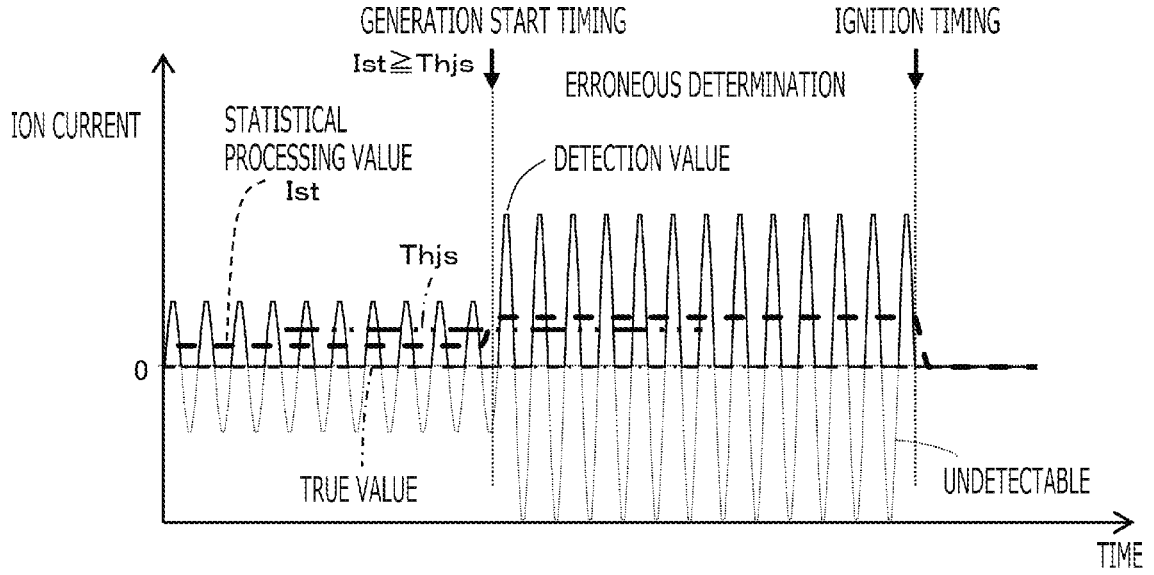
FIG. 9 is a time chart for explaining erroneous determination of the generation start timing of the ion current caused in the case where the noise amplitude is large, for explaining a problem.

As shown in FIG. 9, when the amplitude of the noise component increases in the state where the true value of the ion current is around zero before the ignition timing, the float width of the statistical processing value Ist increases, and the statistical processing value Ist exceeds the start determination threshold value Thjs, and the generation start timing of the ion current may be determined erroneously.

<Determination Prohibition Processing by Minimum Value Imin of Ion Current>

Accordingly, the combustion state determination unit 52 implements a determination prohibition processing that calculates a minimum value Imin of the ion current during the processing period ΔTc at each time point of the determination period Tj, and prohibits determination of the combustion state at a time point when the minimum value Imin of the ion current is below a preliminarily set determination prohibition threshold value Thjp.

For example, the combustion state determination unit 52 changes a processing time point tp from the start point of the determination period Tj to the end point, and repeatedly performs minimum value calculation processing that calculates the minimum value Imin of the ion current sampled during the processing period ΔTc centered at the processing time point tp (from tp−ΔTc/2 to tp+ΔTc/2), to calculate the minimum value Imin at each time point of the determination period Tj.

The combustion state determination unit 52 determines the combustion state of each combustion based on the statistical processing value Ist at each time point when the minimum value Imin of ion current becomes larger than the determination prohibition threshold value Thjp. In the present embodiment, the combustion state determination unit 52 determines the generation end timing and the generation start timing of the ion current as mentioned above, based on the statistical processing value Ist at each time point when the minimum value Imin of the ion current becomes larger than the determination prohibition threshold value Thjp. The determination prohibition threshold, value Thjp is set to a value smaller than the end determination threshold value Thjf and the start determination threshold value Thjs.

According to this configuration, when the minimum value Imin of the ion current becomes below the determination prohibition threshold value Thjp, it can be determined that the true value of the ion current drops to around zero, and the determination of the combustion state in this case can be prohibited. As shown in FIG. 10 corresponding to FIG. 7, in the case where the amplitude of the noise component is large, before the generation end timing of the ion current is determined erroneously, the minimum value Imin of the ion current becomes below the determination prohibition threshold value Thjp, the determination of the combustion state can be prohibited, and the determination of the combustion state of this combustion time can be stopped. On the other hand, as shown in FIG. 11 corresponding to FIG. 8, in the case where the amplitude of the noise component is small, after normal determination of the generation end timing of the ion current is performed, the minimum value Imin of the ion current becomes below the determination prohibition threshold value Thjp, and the determination of the combustion state is prohibited, accordingly the determination of the combustion state of this combustion time can be implemented. Therefore, the determination of the combustion state which becomes erroneous determination is not performed, but the determination of the combustion state which becomes normal determination can be performed. Since the amplitude of the noise component is irregularly fluctuated every combustion and at each time point, even if the combustion state cannot be determined in this combustion time, the combustion state can be determined intermittently, for example, the combustion state can be determined in the next combustion time. Therefore, a combustion state control described below can be performed based on the intermittent determination result of the combustion state.

As shown in FIG. 12 corresponding to FIG. 9, even if the amplitude of the noise component increases in the state where the true value of the ion current is around zero before the ignition timing, since the minimum value Imin of the ion current is below the determination prohibition threshold value Thjp, the determination of the combustion state is prohibited, and erroneous determination of the generation start timing of the ion current can be prevented.

2-4. The Combustion State Control Unit 53

The combustion state control unit 53 implements a combustion state control processing that controls the combustion state based on the determination result of the combustion state by the combustion state determination unit 52. In the present embodiment, the combustion state control unit 53 implements a preignition suppression control that suppresses occurrence of preignition according to the intensity of preignition determined by the combustion state determination unit 52. Specifically, the combustion state control unit 53 performs one or both of a decrease of charging efficiency and a change of fuel injection, in the case where the intensity of preignition becomes large. There is fuel cut or enrichment as the change of fuel injection. The combustion state control unit 53 performs fuel cut in the case where the intensity of preignition becomes larger than a threshold value, and performs enrichment according to the intensity of preignition in the case where the intensity of preignition is smaller than the threshold value. In the case where the injector 13 which injects fuel directly in the combustion chamber 25 is provided, compression stroke injection may be performed as enrichment.

According to the intensity of preignition, the combustion state control unit 53 changes the phase angle of one or both of the intake variable valve timing mechanism 14 and the exhaust variable valve timing mechanism 15 so that charging efficiency (intake air amount in the combustion chamber 25) decreases.

2-5. Flowchart

Figure 13:
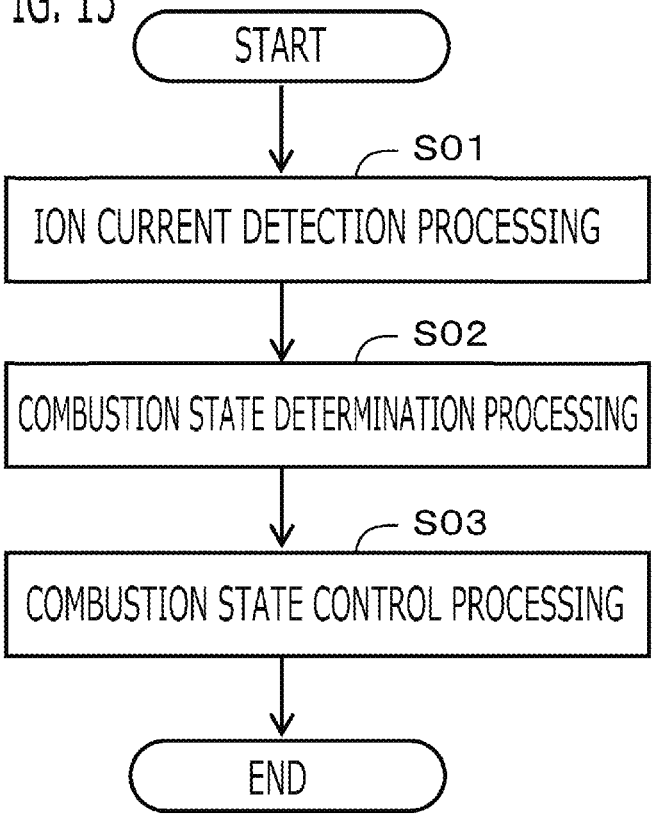
FIG. 13 is a flow chart showing the processing by the controller according to Embodiment 1 of the present invention.

The procedure (the control method of internal combustion engine 1) of schematic processing of the controller 50 concerning the present embodiment is explained based on the flow chart shown in FIG. 13. The processing represented in the flowchart in FIG. 13 is recurrently executed every predetermined operation cycle by the computing processing unit 90 executing software (a program) stored in the storage apparatus 91.

In the step S01, as mentioned above, the ion current detection unit 51 implements the ion current detection processing (an ion current detection step) that detects the ion current generated by combustion of the fuel-air mixture based on the output signal of the ion current detection circuit 19.

In the step S02, as mentioned above, the combustion state determination unit 52 implements the combustion state determination processing (a combustion state determination step) that determines the combustion state of each combustion chamber 25 based on the ion current during the determination period Tj set corresponding to the combustion period of each combustion chamber 25. At this time, as mentioned above, the combustion state determination unit 52 implements the determination prohibition processing that calculates the minimum value Imin of the ion current during the processing period ΔTc at each time point of the determination period Tj, and prohibits determination of the combustion state at a time point when the minimum value Imin of the ion current is below a preliminarily set determination prohibition threshold value Thjp.

In the step S03, as mentioned above, the combustion state control unit 53 implements the combustion state control processing (a combustion state control step) that controls the combustion state based on the determination result of the combustion state by the combustion state determination unit 52.

Other Embodiments

Lastly, other embodiments of the present invention will be explained. Each of the configurations of embodiments to be explained below is not limited to be separately utilized but can be utilized in combination with the configurations of other embodiments as long as no discrepancy occurs.

(1) In the above-mentioned Embodiment 1, there has been explained the case where the combustion state determination unit 52 determines occurrence of preignition as the combustion state. However, embodiments of the present invention are not limited to the foregoing case. For example, the combustion state determination unit 52 may determine occurrence of knock as the combustion state. For example, the combustion state determination unit 52 may extract a component of a knock occurrence frequency band included in the ion current with a band pass filter and the like, and may determine the intensity of knock based on the extracted value. Even in this case, like Embodiment 1, the combustion state determination unit 52 calculates the minimum value Imin of the ion current during the processing period ΔTc, and prohibits determination of the knock occurrence at a time point when the minimum value Imin of the ion current is below a preliminarily set determination prohibition threshold value Thjp. The combustion state control unit 53 may change the ignition timing to the retard angle side according to the intensity of knock, as control of the combustion state.

(2) In the above-mentioned Embodiment 1, there has been explained the case where the combustion state determination unit 52 determines a time point (crank angle) when the statistical processing value Ist of the ion current during the determination period Tj becomes lower than a preliminarily set end determination threshold value Thjf after the ignition timing, as the generation end timing of the ion current, and then determines that the intensity of preignition becomes larger as the determined generation end timing of the ion current becomes the advance angle side more. However, embodiments of the present invention are not limited to the foregoing case. The combustion state determination unit 52 may determine a peak time point (crank angle) of the crest of the latter half after the ignition timing based on the statistical processing value Ist of the ion current during the determination period Tj. Then, the combustion state determination unit 52 determines that the intensity of preignition becomes larger as the determined peak time point of the crest of the latter half becomes the advance angle side more than a preliminarily set peak time point of the crest of the latter half at the normal combustion.

Various modifications and alterations of this invention will be apparent to those skilled in the art without departing from the scope and spirit of this invention, and it should be understood that this is not limited to the illustrative embodiments set forth herein.

What is claimed is:

1. A controller for an internal combustion engine that is provided with an spark plug which ignites a fuel-air mixture in a combustion chamber, an ignition coil which supplies an ignition energy to the spark plug, and an ion current detection circuit which outputs an output signal according to an ion current which flows into a discharge electrode of the spark plug, the controller for the internal combustion engine comprising:

an ion current detector that detects the ion current generated by combustion of the fuel-air mixture based on the output signal of the ion current detection circuit, and a combustion state determination calculator that determines a combustion state of each combustion based on the ion current during a determination period which is set corresponding to a combustion period of each combustion, wherein the combustion state determination calculator calculates a minimum value of the ion current during a processing period at each time point of the determination period, and prohibits determination of the combustion state at a time point when the minimum value of the ion current is below a preliminarily set determination prohibition threshold value.

2. The controller for the internal combustion engine according to claim 1, wherein the combustion state determination calculator calculates a statistical processing value of the ion current during the processing period at each time point of the determination period, and determines the combustion state of each combustion based on the statistical processing value at each time point when the minimum value of the ion current becomes larger than the determination prohibition threshold value.

3. The controller for the internal combustion engine according to claim 2, wherein the combustion state determination calculator calculates, as the statistical processing value, an average value of the ion current during the processing period or a median value of a maximum value and a minimum value of the ion current during the processing period.

4. The controller for the internal combustion engine according to claim 1, wherein the processing period is set to a period greater than or equal to one cycle of a periodic noise component superimposed on the ion current.

5. The controller for the internal combustion engine according to claim 1, wherein the combustion state determination calculator sets the processing period to a period greater than or equal to one cycle of a periodic noise component superimposed on a power source voltage supplied to the ignition coil.

6. The controller for the internal combustion engine according to claim 1, further comprising a combustion state controller that controls the combustion state based on a determination result of the combustion state by the combustion state determination calculator.

7. The controller for the internal combustion engine according to claim 1, wherein the minimum value of the ion current is a minimum amplitude of the ion current during the processing period.

8. A control method for an internal combustion engine that is provided with a spark plug which ignites a fuel-air mixture in a combustion chamber, an ignition coil which supplies an ignition energy to the spark plug, and an ion current detection circuit which outputs an output signal according to an ion current which flows into a discharge electrode of the spark plug, the control method for the internal combustion engine comprising:

an ion current detecting that detects the ion current generated by combustion of the fuel-air mixture based on the output signal of the ion current detection circuit, and a combustion state determining that determines a combustion state of each combustion based on the ion current during a determination period which is set corresponding to a combustion period of each combustion, wherein the combustion state determining calculates a minimum value of the ion current during a processing period at each time point of the determination period, and prohibits determination of the combustion state at a time point when the minimum value of the ion current is below a preliminarily set determination prohibition threshold value.

* * * * *